United States Patent [19]

Brentham

[11] 4,254,949

[45] Mar. 10, 1981

[54] LEG CURL EXERCISING DEVICE

[76] Inventor: Jerry D. Brentham, 102 Elm Dr., Belton, Tex. 75613

[21] Appl. No.: 914,356

[22] Filed: Jun. 12, 1978

[51] Int. Cl.[3] ..... A63B 23/04

[52] U.S. Cl. ..... 272/130; 272/134

[58] Field of Search ..... 272/134, 130, 131, 132, 272/116, 117; 128/25 R, 25 B

[56] References Cited

U.S. PATENT DOCUMENTS

| | | | |
|---|---|---|---|
| 1,902,694 | 3/1933 | Edwards | 272/134 |
| 2,068,578 | 1/1937 | Stronach | 272/130 |
| 2,855,199 | 10/1958 | Noland | 272/134 X |
| 3,000,632 | 9/1961 | Fuchs | 272/117 |
| 3,103,357 | 9/1963 | Berne | 272/134 X |
| 3,120,954 | 2/1964 | Apostol | 272/134 X |
| 3,285,070 | 11/1966 | McDonough | 272/134 |
| 3,465,592 | 9/1969 | Perrine | 73/379 |
| 3,495,824 | 2/1970 | Cunnier | 272/130 |
| 3,784,194 | 1/1974 | Perrine | 272/130 |
| 3,822,599 | 7/1974 | Brentham | 272/130 |
| 3,861,677 | 1/1975 | Wheeldon | 272/130 |

OTHER PUBLICATIONS

"Time Machines by Nautilus" insert to Iron Man Magazine, Jul. 1973, pp. 1, 42 and 49.

Universal Gymnastics Catalog, p. 28, 1974, Universal Athletics Sales, Fresno, Calif.

*Primary Examiner*—Richard J. Johnson

*Attorney, Agent, or Firm*—Gerald G. Crutsinger; John F. Booth; Harry C. Post, III

[57] ABSTRACT

A leg exercising device comprising a general frame having an L-shaped seat for supporting the body and a leg gripping frame pivotally secured to the general frame such that the axis of rotation of the leg gripping frame is aligned with the knee of the user. The leg gripping frame has resilient pads which allow the leg to pass therethrough such that the leg is padded from the frame as it moves in both directions. A power cylinder is pivotally secured between the general frame and the leg gripping frame to provide a resistance to pivotal movement of the leg gripping frame about the axis of rotation in both directions.

5 Claims, 5 Drawing Figures

LEG CURL EXERCISING DEVICE

BACKGROUND

Exercising devices generally serve two purposes, to strengthen the muscles and to rehabilitate the muscles. To prevent injuries from occuring to the knee it is important that athletes involved in contact sports strengthen the muscles controlling the knee. The most efficient way to strengthen the muscles in the knee is to isolate the knee muscles from the rest of the body for effective exercising.

Heretofore, devices which are designed to strengthen the knee generally comprise devices having a series of pulleys and ropes for lifting weight. The devices tend to exercise in only a single direction and furthermore cannot be released at any point except the lowermost point of the weight.

Other devices such as those disclosed in U.S. Pat. Nos. 3,120,954; 3,465,592; 3,495,824; and 3,822,599 generally use sophisticated hydraulic structures and pumps which add to the cost and complexity of the device and thereby reduce their availability to the general public.

SUMMARY

I have devised a knee exercising device comprising a general frame adapted to sit on the floor and support the body. A seat support and a back support are secured to the general frame at an obtuse angle to each other and form a body support for supporting the user.

Actuating means such as a leg gripping frame is pivotally secured to the general frame such that the axis of pivotal movement is aligned with the axis of pivotal movement of the leg of the user. Actuated means, such as a double resistant power cylinder, is pivotally secured between the general frame and the leg gripping frame such that pivotal movement of the leg gripping frame by the leg of the user is resisted.

The leg gripping frame generally comprises an outwardly extending support arm having a lug formed on the end thereof to support a pair of pads rotatably secured to the lug and adapted to engage opposed sides of the leg of the user. A second set of pads may be affixed to a second side of the arm such that both legs of the user may be positioned on each side of the outwardly extending arm between a pair of pads.

A body restraint arm generally comprising an upwardly extending hand grip is adapted to restrain forward movement of the body upon movement of the legs upwardly.

A primary object of the invention is to provide a leg exercising device which isolates the leg muscles to efficiently strengthen the leg muscles to prevent injuries to athletes while they are engaged in sporting activities.

A further object of the invention is to provide a simple, efficient leg exercising device which is completely controlled by the user to minimize the possibility of injury to the user if he becomes exhausted or tired.

A still further object of the invention is to provide a leg exercising device which requires extended output by the muscles of the user to move the leg in each direction and which orientes the leg gripping device such that the axis of rotation is coaxially aligned with the axis of rotation of the knee to minimize strain on the knee.

Other and further objects of the invention will become apparent upon referring to the detailed description following and the drawings annexed hereto.

DESCRIPTION OF THE DRAWINGS

Drawings of a preferred embodiment of the invention are annexed hereto so that the invention may be more fully understood, in which.

Numeral references are employed to designate like parts throughout the various figures of the drawings.

DESCRIPTION OF A PREFERRED EMBODIMENT

Figure 1:
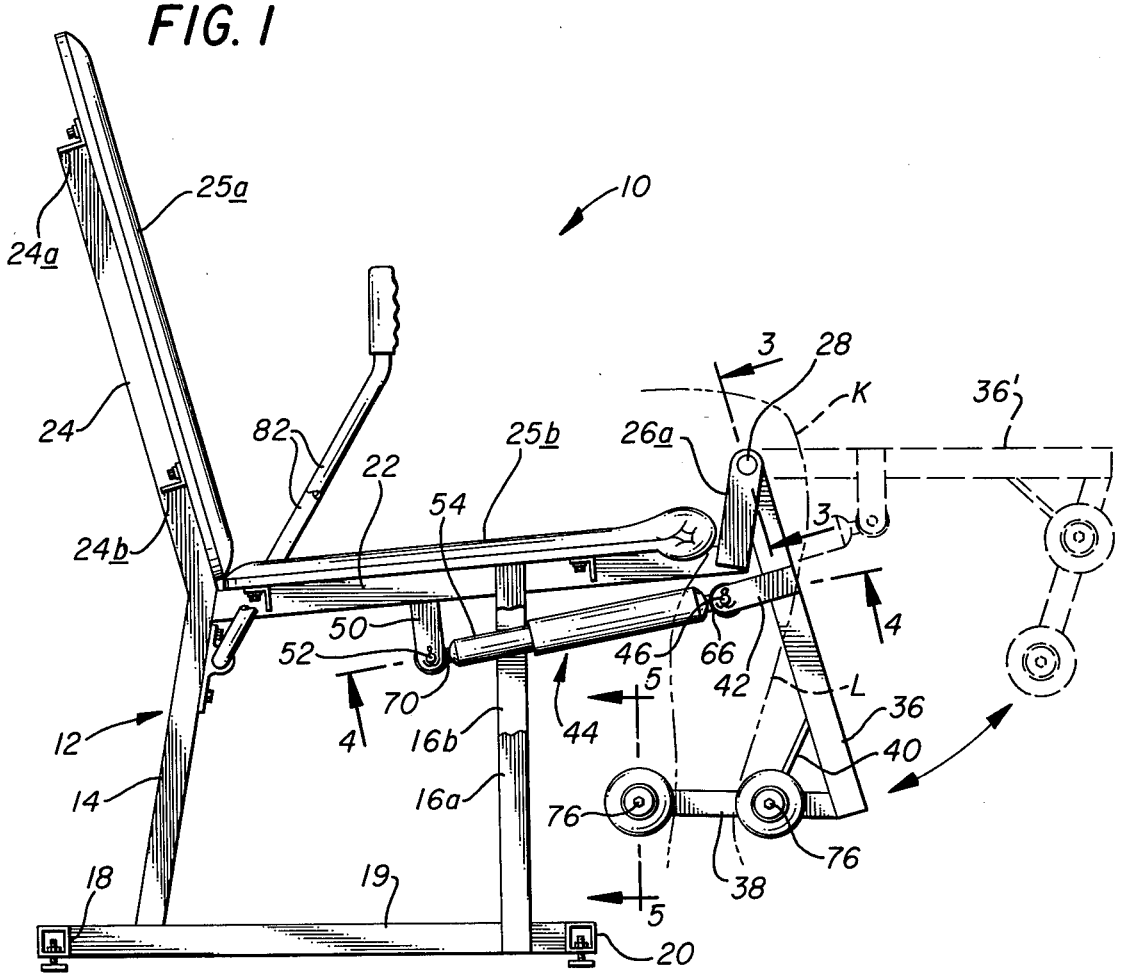
FIG. 1 is a front elevational view of the leg exercising device.
Figure 2:
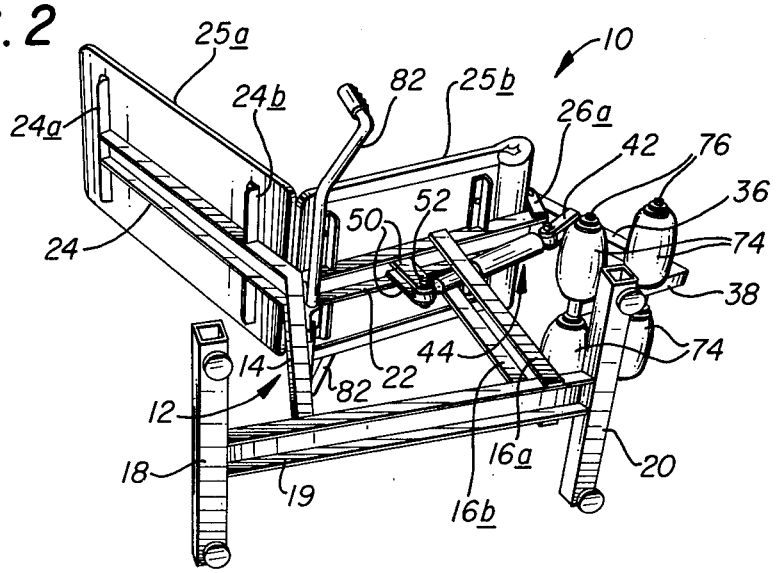
FIG. 2 is a bottom plan perspective view thereof.
Figure 3:
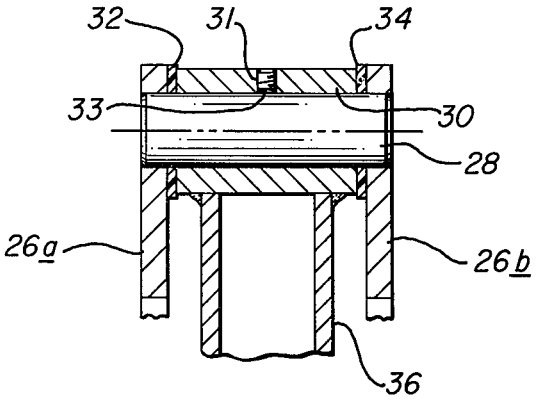
FIG. 3 is a cross-sectional view taken along line 3—3 of FIG. 1.
Figure 4:
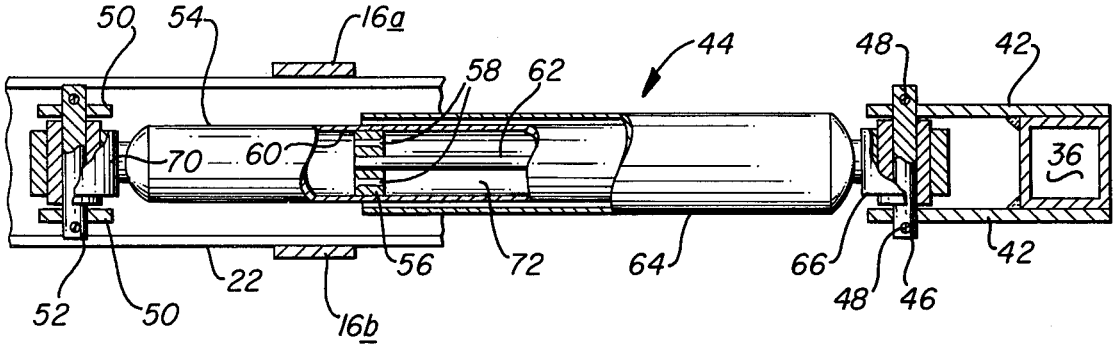
FIG. 4 is a cross-sectional view taken along line 4—4 of FIG. 4.
Figure 5:
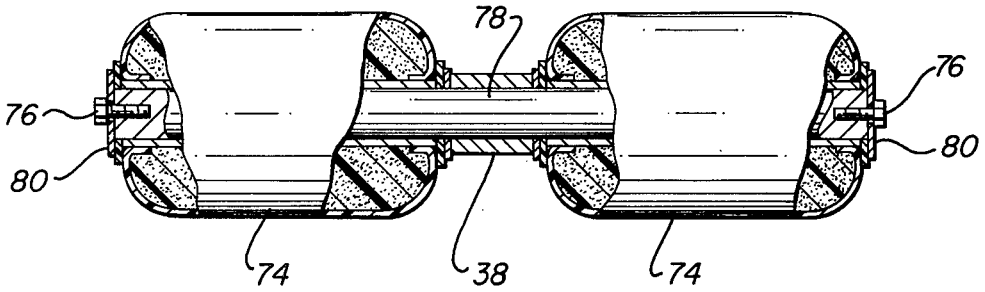
FIG. 5 is a cross-sectional view taken along line 5—5 of FIG. 1.

Referring to FIGS. 1 and 2 of the drawings, the numeral 10 generally designates a leg curl exercising device.

The leg curl exercising device generally comprises a frame 12 having a generally vertical rear leg 14 and a pair of spaced front legs 16*a* and 16*b* which are secured to a base. The base comprises a rear end member 18 secured in substantially perpendicular relationship to connector member 19 secured to a perpendicular front end member 20.

Rear leg 14 and front legs 16*a* and 16*b* are secured to an upper longitudinal support member 22 which is secured to an L-shaped support member 24. Upper support members 22 and 24 are generally parallel to the longitudinal axis of the leg curl exercising device 10. Cross-members 24*a* and 24*b* provide a support for back support member 25*a* generally comprising a cushion secured to a flat, rectangular support. Cross-members 22*a* and 22*b* secured to longitudinal member 22 provide support for the seat support member 25*b* generally comprising a cushion secured to a flat, rectangular support.

It should be noted from FIG. 2 of the drawing that front leg members 16*a* and 16*b* are preferably set in from the front portion of the seat support 25*b* and longitudinal upper support 22. A clevis is formed on the front end of longitudinal support 22 by angularly disposed lugs 26*a* and 26*b* welded or otherwise secured to the end of upper longitudinal member 22.

It should be appreciated that back support member 25*a* is preferably positioned at an obtuse angle slightly greater than ninety degrees to seat support 25*b* to place the body in a position such that the upper torso is slightly bent forward from the hip which corresponds to the position in which the body is generally placed when working or engaging in sporting activities.

Actuating means, such as a leg gripping frame, generally comprises an outwardly extending support arm 36 welded or otherwise secured to a sleeve 30 which is rotatably disposed on shaft 28 between bushings 32 and 34 secured between lugs 26*a* and 26*b*. A set screw 31 is threadedly secured through sleeve 30 into a passage 33 formed in shaft 28. The ends of shaft 28 are preferably substantially flush with lugs 26*a* and 26*b* so as not to interfere with the user.

It should be readily apparent from the drawings that the axis of rotation 28*a* of shaft 28 and arm 36 is preferably aligned with the axis of rotation of the knee K which when the user positions his body supports 25*a* and 25*b* is substantially coaxially aligned therewith. As shown in dashed outline, the knee K bends at this joint.

Arm 36 has an inwardly extending arm 38 secured to the end thereof to form a substantially L-shaped member and has an angular brace 40 to strengthen the leg gripping means. Arm 38 is preferably oriented such that it is substantially perpendicular to a radial line passing through the axis of rotation of shaft 28 and the knee K so as to minimize strain on the knee and maximize stress on the muscles for bending the leg.

The actuating means further comprises leg engagement means such as a pair of padded rollers 74 rotatably secured to shaft 78 rigidly secured to arm 38. Washers 80 are secured to each side of rollers 74 to limit longitudinal movement of rollers 74 relative to shaft 78 by bolt 76 threadedly secured in the end of shaft 78. The rollers 74 are oriented on arm 38 so as to engage opposed sides of the leg L shown in dashed outlines. A pair of rollers 74 are disposed on each side of arm 38 in a like manner.

It should be readily apparent from the drawing that the actuating means is moveable from a first position shown in full outline in FIG. 1, wherein the knee K is bent at an angle of less than ninety degrees and actuating means is moved under longitudinal support 22, to a second position 36' shown in dashed outline wherein the leg would be substantially straight.

Actuated means such as a two-way resistant cylinder 44 is pivotally secured between the frame and the actuating means arm 36.

The cylinder 44 is of a type similar to a standard motorcycle racing shock absorber. The cylinder provides substantially equal resistance to pivotal movement of arm 36 about shaft 28 in both clockwise and counterclockwise directions as viewed in FIG. 1. A cylinder 44 resists movement by the user but does not move the leg of the user.

A first end 66 of cylinder 44 is secured by shaft 46 in clevis lugs 42 welded or otherwise secured to the central portion of arm 36. A cotter pin 48 maintains shaft 46 within the clevis 42. A second end 70 is likewise secured in clevis lugs 50 welded to the central lower portion of upper longitudinal support 22 and rotatably secured thereto by a pin 52. Cylinder 44 generally passes through spaced front legs 16*a* and 16*b*.

The fluid flow resistance means generally comprises a cylindrical shaped chamber 54 having an inner wall 60 through which piston 56 is slideably disposed. Piston 56 is secured to a connecting rod 62 which is secured to the end housing 64 slideably disposed over the exterior of chamber 54 and secured to end 66. Piston 56 has a pair of check valves 58 secured therein in opposed relation to each other for controlling the flow of fluid from the first end of chamber 54 on one side of piston 56 to the other end of chamber 54 on the opposite side of piston 56. The fluid generally comprises a standard fluid such as hydraulic oil, silicone or other similar fluids generally used in shock absorbers.

Upper body restraint means 82 generally comprising upwardly extending arms adapted to provide hand grips for limiting forward motion of the body of the user when lifting the leg to a position shown in dashed outline 36'.

Operation of the hereinbefore described device is as follows:

The user places his body on the body support members 25*a* and 25*b* such that the knee is oriented on opposite sides of shaft 28. The user extends his leg through roller 74 on each side of arm 36. He relaxes his body and grips the hand grip and proceeds to apply force to move arm 36 from first position to the second position 36' shown in dashed outline.

Should for various reasons, such as the size of the user, the knee K is not aligned with shaft 28, rollers 74 will rotate and allow movement of the leg L relative to the rollers 74 as the leg is raised and lowered.

From the foregoing it should be readily apparent that each of the embodiments hereinbefore described accomplishes the objects of the invention hereinbefore discussed.

It should be appreciated that other and further embodiments of the invention may be devised without departing from the basic concept thereof.

Having described my invention, I claim:

1. A leg curl exercising device comprising: a support frame; a seat support member on said frame; a back support member on said frame, said seat support member and back being oriented at an obtuse angle relative to one another; hand grip means upwardly of the seat support and forwardly of the back support on each side of said frame to resist movement of the body of a user; actuating means pivotally secured to said support frame for engaging the legs of a user such that the axis of rotation of said actuating means is substantially coaxially aligned with the axis of rotation of the knee joints of the user, said actuating means extending between the knees of the user; double resistant actuated means pivotally secured to the support frame and to the actuating means for resisting movement of said actuating means in said direction between a position with the leg beneath the knee of the user being at an acute angle relative to the leg above the knee and a position with the leg being substantially extended; and roller means extending outwardly from each side of said actuating means to simultaneously engage the front and rear of each ankle of the user.

2. The combination called for in claim 1 wherein said actuated means comprises: an outwardly extending exercise arm positioned on said support frame to have a leg of the user disposed on each side thereof.

3. The combination called for in claim 1 wherein said support frame comprises: front and rear legs; and upper longitudinal support member secured to said front and rear legs, said front leg being spaced inwardly from the axis of rotation of said actuating means.

4. The combination called for in claim 1 wherein said double resistant actuated means comprises: a cylinder having fluid disposed therein; means pivotally securing an end of said cylinder to said support frame; a piston rod; means pivotally securing an end of said piston rod to said actuating means; a piston secured to the other end of said rod and slideably disposed in said cylinder; means mounted on said piston for resisting movement of the fluid in said cylinder from one side of said piston to the other side of said piston.

5. The combination called for in claim 1, wherein the support frame comprises: front and rear legs, an upper longitudinal support member, said front leg being spaced inwardly from the axis of rotation of said actuating means, said seat support member being secured to said upper longitudinal support member, and wherein the double resistant actuated means comprises: an outwardly extending exercise arm positioned on said support frame to have a leg of the user disposed on each side thereof, means rotatably securing the rollers in a plane extending substantially perpendicular to a radial line passing through the axis of rotation of the actuating means, a cylinder having fluid disposed therein, means pivotally securing a first end of the cylinder to said support frame, a piston rod pivotally secured to said actuating means, a piston secured to an end of said rod and slideably disposed in the cylinder, and means mounted with the piston for resisting movement of the fluid from one side of the piston to the other side of the piston.

* * * * *